US011210886B2

(12) United States Patent
Miyashita et al.

(10) Patent No.: US 11,210,886 B2
(45) Date of Patent: Dec. 28, 2021

(54) PAPER SHEET IDENTIFICATION DEVICE AND PAPER SHEET IDENTIFICATION SYSTEM

(71) Applicant: Japan Cash Machine Co., Ltd., Osaka (JP)

(72) Inventors: Yousuke Miyashita, Osaka (JP); Makoto Hasegawa, Osaka (JP)

(73) Assignee: Japan Cash Machine Co., Ltd., Osaka (JP)

( * ) Notice: Subject to any disclaimer, the term of this patent is extended or adjusted under 35 U.S.C. 154(b) by 176 days.

(21) Appl. No.: 16/486,472

(22) PCT Filed: Mar. 7, 2018

(86) PCT No.: PCT/JP2018/008838
§ 371 (c)(1),
(2) Date: Aug. 15, 2019

(87) PCT Pub. No.: WO2018/190039
PCT Pub. Date: Oct. 18, 2018

(65) Prior Publication Data

US 2020/0035056 A1 Jan. 30, 2020

(30) Foreign Application Priority Data

Apr. 12, 2017 (JP) ..... JP2017-078989

(51) Int. Cl.
*G07D 7/12* (2016.01)
*G07D 11/50* (2019.01)
(Continued)

(52) U.S. Cl.
CPC ..... *G07D 7/12* (2013.01); *G07D 7/04* (2013.01); *G07D 9/00* (2013.01); *G07D 11/50* (2019.01)

(58) Field of Classification Search
CPC . G07D 7/12; G07D 11/50; G07D 7/04; G07D 9/00
(Continued)

(56) References Cited

U.S. PATENT DOCUMENTS 8,478,020 B1 7/2013 Jones et al.
10,163,291 B2 * 12/2018 Numata ..... G07D 11/36
(Continued)

FOREIGN PATENT DOCUMENTS

EP 2410496 A1 1/2012
JP 2004-265288 A 9/2004
(Continued)

OTHER PUBLICATIONS

EPO, the extended European Search Report dated Dec. 23, 2020 in European Application No. EP18784012.9, 8 pages.
(Continued)

*Primary Examiner* — Daniel A Hess
(74) *Attorney, Agent, or Firm* — Masuvalley & Partners

(57) ABSTRACT

An object of the present invention is to avoid as much as possible a state where recognition results with respect to the same paper sheet become different. Provided is a paper sheet identification system including a first paper sheet identification device and a second paper sheet identification device. The second paper sheet identification device includes a second identification unit that identifies the authenticity of paper sheets based on a second set value, and a first acquisition unit that acquires previous process data.

6 Claims, 9 Drawing Sheets

(51) Int. Cl.
*G07D 7/04* (2016.01)
*G07D 9/00* (2006.01)

(58) Field of Classification Search
USPC ..... 194/206
See application file for complete search history.

(56) References Cited

U.S. PATENT DOCUMENTS

| | | | | |
|---|---|---|---|---|
| 2017/0358164 | A1 | 12/2017 | Numata et al. | |
| 2019/0080545 | A1* | 3/2019 | Numata | G07D 7/00 |

FOREIGN PATENT DOCUMENTS

| | | | |
|---|---|---|---|
| JP | 2006-072918 | A | 3/2006 |
| JP | 2012-198612 | A | 10/2012 |
| JP | 2015-156050 | A | 8/2015 |
| JP | 2016-103054 | A | 6/2016 |
| WO | WO2009/122502 | A1 | 10/2009 |
| WO | WO 2016/084856 | A1 | 6/2016 |

OTHER PUBLICATIONS

WIPO, Japanese International Search Authority, International Search Report and Written Opinion dated Jun. 5, 2018 in International Patent Application No. PCT/JP2018/008838, 7 pages.

* cited by examiner

SECTION(A)

SECTION(B)

SECTION(C)

PAPER SHEET IDENTIFICATION DEVICE AND PAPER SHEET IDENTIFICATION SYSTEM

RELATED APPLICATIONS

This application is the U.S. National Phase of and claims priority to International Patent Application No. PCT/JP2018/008838, International Filing Date Mar. 7, 2018, entitled Paper Sheet Identification System; which claims benefit of Japanese Application No. JP2017-078989 filed Apr. 12, 2017; both of which are incorporated herein by reference in their entireties.

FIELD

The present invention relates to a paper sheet identification system that identifies a paper sheet.

BACKGROUND

Conventionally, a banknote processing device that processes banknotes is installed in, for example, respective shops of banking facilities and distribution industry. As a system including such a banknote processing device, a system described in Patent Literature 1 has been conventionally known, which is configured to transfer banknotes collected from an automatic banknote handling device to the banknote processing device. In the system described in Patent Literature 1, the automatic banknote handling device that reads a serial number of a banknote and the banknote processing device are connected with each other via a communication network. The automatic banknote handling device transmits the serial numbers of the collected banknotes to the banknote processing device. On the other hand, the banknote processing device reads the serial numbers of the transferred banknotes, to specify a read serial number that does not match with the serial number of the banknote previously received. According to the configuration, the system described in Patent Literature 1 reliably manages banknotes so as to enable detection of theft and the like and specification of the stolen banknotes.

CITATION LIST

Patent Literature

Patent Literature 1: Japanese Patent Application Laid-open No. 2006-72918

SUMMARY

Technical Problem

However, in the system described in Patent Literature 1, when banknotes are transferred from the automatic banknote handling device to the banknote processing device, there is a problem that recognition results with respect to the same banknote may be different between the respective devices. That is, the system described in Patent Literature 1 specifies banknotes with matched banknote serial numbers at the time of transferring the banknotes from the automatic banknote handling device to the banknote processing device. However, the system does not guarantee that recognition results such as the authenticity with respect to the same banknote match with each other between the respective devices. Therefore, such a state may occur that recognition results with respect to the same banknote are different between the respective devices. This applies not only to banknotes but also to general paper sheets including marketable securities.

The present invention has been achieved in view of the above problem, and an object of the present invention is to provide a paper sheet identification device that can avoid as much as possible a state where, when paper sheets are transferred from a device to another device, recognition results with respect to the same paper sheet become different.

Solution to Problem

An aspect of the present invention provides a paper sheet identification device including an identification unit that identifies a paper sheet, the paper sheet identification device comprising:

a memory that memorizes specific information acquired when another device has identified the paper sheet; and a condition relaxing unit that can relax conditions for judgment that the paper sheet is authentic by the identification unit according to the specific information In the above aspect, a state where recognition results with respect to the same paper sheet become different between respective devices can be avoided as much as possible.

Further, a paper sheet identification system adopting the present invention is a paper sheet identification system comprising a first paper sheet identification device and a second paper sheet identification device, wherein the first paper sheet identification device includes a first read unit that reads a specific code described on a surface of a paper sheet to uniquely specify the paper sheet, a first identification unit that identifies authenticity of the paper sheet using a first set value as a reference, and a first storage unit that stores authentic paper sheets, which are paper sheets identified as authentic by the first identification unit, the first identification unit generates previous process data in which the specific code, the first set value, and a first identification result obtained by the first identification unit of the authentic paper sheet are associated with each other, the second paper sheet identification device includes a second read unit that reads the specific code described on the surface of the paper sheet, which has been taken out from the first storage unit and loaded into a slot, a second identification unit that identifies authenticity of the paper sheet using a second set value as a reference, a second storage unit that stores the paper sheets identified as authentic by the second identification unit, and a first acquisition unit that acquires the previous process data, and the second identification unit extracts the first set value and the first identification result from the previous process data when the paper sheet is identified as a counterfeit paper sheet, which is not authentic, using the second set value as a reference, in which the first set value and the first identification result are associated with the specific code of the counterfeit paper sheet, determines whether to relax the second set value based on the extracted first set value and the first identification result, and upon relaxation of the second set value, identifies authenticity of the counterfeit paper sheet using the relaxed second set value as a reference.

According to the present aspect, the previous process data in which the specific code, the first set value, and the first identification result of the authentic paper sheet, which is the paper sheet identified as authentic by the first identification unit, are associated with each other is acquired by the first acquisition unit of the second paper sheet identification device. In the second paper sheet identification device, when a paper sheet is identified as a counterfeit paper sheet that is counterfeit based on the second set value, the first set value and the first identification result associated with the specific code of the counterfeit paper sheet are extracted from the previous process data. It is then determined whether to relax the second set value based on the extracted first set value and first identification result. Upon relaxation of the second set value, the authenticity of the counterfeit paper sheet is identified based on the relaxed second set value.

Therefore, according to the present aspect, with regard to the paper sheet identified as counterfeit by the second paper sheet identification device, it is determined whether to relax the second set value based on the first set value and the first identification result, at the time of being identified as authentic by the first paper sheet identification device. Accordingly, the identification result obtained by the first paper sheet identification device can be used. Therefore, a state where recognition results with respect to the same paper sheet become different can be avoided as much as possible. Accordingly, it can be suppressed that the paper sheet identified as authentic by the first paper sheet identification device is identified as counterfeit by the second paper sheet identification device, thereby enabling to suppress that handling of paper sheets becomes complicated.

Further, according to the present aspect, since the paper sheets include old paper sheets and damaged paper sheets such as soiled, folded, or torn paper sheets, even for a case in which even if a paper sheet is identified as authentic by the first paper sheet identification device, the paper sheet is identified as counterfeit by an error by the second paper sheet identification device, the paper sheet can be correctly identified as authentic.

In the above aspect, for example, the second identification unit may determine to relax the second set value, when a level difference between the first set value and a first detection signal acquired from the paper sheet or a quotient obtained by dividing the level difference by the first set value is less than a first threshold.

According to the present aspect, when the level difference between the first set value and the first detection signal or the quotient obtained by dividing the level difference by the first set value is less than the first threshold, it is determined to relax the second set value. Accordingly, when a margin at the time of being identified as authentic by the first paper sheet identification device is small, the second set value is relaxed. Therefore, according to the present aspect, it can be prevented that the second set value is relaxed more than necessary.

In the above aspect, for example, the second identification unit may determine whether to relax the second set value, based on the second set value and a second identification result using the second set value as a base, in addition to the first set value and the first identification result, upon identification that the paper sheet is a counterfeit paper sheet that is not authentic using the second set value as a reference.

According to the present aspect, when the paper sheet is identified as a counterfeit paper sheet that is not authentic based on the second set value, it is determined whether to relax the second set value, based on the second set value and the second identification result using the second set value as a reference, in addition to the first set value and the first identification result. Accordingly, based on the identification result obtained by the second paper sheet identification device in addition to the identification result obtained by the first paper sheet identification device, it is determined whether to relax the second set value. Therefore, according to the present aspect, it can be prevented that the second set value is relaxed more than necessary.

In the above aspect, for example, the second identification unit may determine to relax the second set value, when a first level difference between the first set value and a first detection signal acquired from the paper sheet or a quotient obtained by dividing the first level difference by the first set value is less than a first threshold, and a second level difference between the second set value and a second detection signal acquired from the paper sheet or a quotient obtained by dividing the second level difference by the second set value is less than a second threshold.

According to the present aspect, when the first level difference between the first set value and the first detection signal or the quotient obtained by dividing the first level difference by the first set value is less than the first threshold, and the second level difference between the second set value and the second detection signal or the quotient obtained by dividing the second level difference by the second set value is less than the second threshold, it is determined to relax the second set value. Accordingly, the second set value is relaxed when a margin at the time of being identified as authentic by the first paper sheet identification device is small, and the second level difference at the time of being identified as counterfeit by the second paper sheet identification device is small. Therefore, according to the present aspect, it can be prevented that the second set value is relaxed more than necessary.

In the above aspect, for example, the first set value and the second set value may be same values.

In the above aspect, for example, the first set value and the second set value may be different values.

In the above aspect, for example, a third paper sheet identification device may further be included. The third paper sheet identification device may include a third read unit that reads the specific code described on the surface of the paper sheet, which has been taken out from the second storage unit and loaded into a slot, a third identification unit that identifies authenticity of the paper sheet using a third set value as a reference, a third storage unit that stores the paper sheets identified as authentic by the third identification unit, and a second acquisition unit that acquires the previous process data. The third identification unit may extract the first set value and the first identification result from the previous process data when the paper sheet is identified as a counterfeit paper sheet, which is not authentic, using the third set value as a reference, in which the first set value and the first identification result are associated with the specific code of a counterfeit paper sheet, determine whether to relax the third set value based on the extracted first set value and the first identification result, and upon relaxation of the third set value, identify authenticity of the counterfeit paper sheet using the relaxed third set value as a reference.

According to the present aspect, the previous process data is acquired by the second acquisition unit of the third paper sheet identification device. In the third paper sheet identification device, when the paper sheet is identified as a counterfeit paper sheet that is not authentic based on the third set value, the first set value and the first identification result associated with the specific code of the counterfeit paper sheet are extracted from the previous process data. It is then determined whether to relax the third set value based on the extracted first set value and first identification result.

Upon relaxation of the third set value, the authenticity of the counterfeit paper sheet is identified based on the relaxed third set value.

Therefore, according to the present aspect, with regard to the paper sheet identified as counterfeit by the third paper sheet identification device, it is determined whether to relax the third set value based on the first set value and the first identification result, at the time of being identified as authentic by the first paper sheet identification device. Accordingly, the identification result obtained by the first paper sheet identification device can be used. Therefore, a state where recognition results with respect to the same paper sheet become different can be avoided as much as possible. Accordingly, it can be suppressed that the paper sheet identified as authentic by the first paper sheet identification device is identified as counterfeit by the third paper sheet identification device, thereby enabling to suppress that handling of paper sheets becomes complicated.

Further, according to the present aspect, since the paper sheets include old paper sheets and damaged paper sheets such as soiled, folded, or torn paper sheets, even for a case in which even if a paper sheet is identified as authentic by the first paper sheet identification device, the paper sheet is identified as counterfeit by an error by the third paper sheet identification device, the paper sheet can be correctly identified as authentic.

In the above aspect, for example, an identified data management device configured to be communicable with the first paper sheet identification device and the second paper sheet identification device may further be included. The first paper sheet identification device may further include a first communication unit that transmits the previous process data to the identified data management device. The identified data management device may include a management communication unit that receives the previous process data transmitted from the first communication unit of the first paper sheet identification device, and a management memory unit that memorizes the previous process data received by the management communication unit. The management communication unit may transmit the previous process data memorized in the management memory unit to the second paper sheet identification device. The first acquisition unit may receive the previous process data transmitted by the management communication unit.

In the above aspect, for example, the first paper sheet identification device may further include a first communication unit that stores the previous process data in a portable memory configured communicably. The first acquisition unit may acquire the previous process data from the portable memory in which the previous process data is stored.

Advantageous Effects of Invention

According to the present invention, a state where recognition results with respect to the same paper sheet become different between respective devices can be avoided as much as possible.

Figure 1:
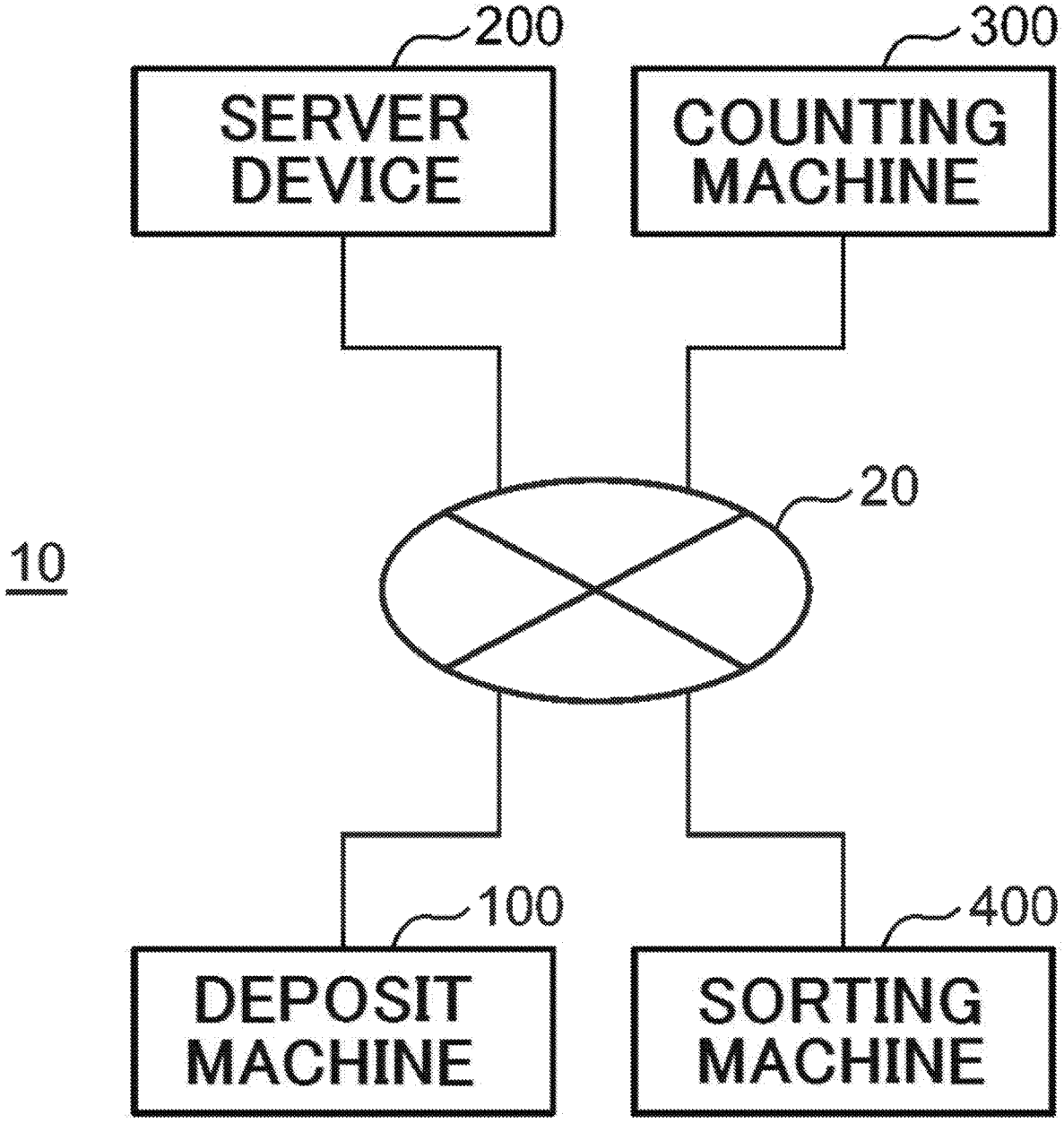
FIG. 1 is a block diagram schematically illustrating a configuration example of a banknote identification system according to the present embodiment.

DESCRIPTION OF EMBODIMENTS (Knowledge as Basis of Present Invention)

First, the knowledge serving as the basis of the present invention is described. Conventionally, the authenticity of a banknote is identified in a banknote identification device such as a deposit machine installed in respective shops of, for example, distribution industry. The banknote identified as authentic is transferred to a cash center. In the cash center, a banknote identification device such as a counting machine and a sorting machine is generally installed. In the counting machine, the authenticity of the banknote is identified and banknotes identified as authentic are counted. In the sorting machine, the authenticity of the banknote is further identified and fitness judgment of the banknote is performed, and the banknotes are stored by denomination. Fitness judgment refers to judgment performed for judging the banknotes identified as a genuine note to be a fit note in a good condition or an unfit note having damages such as being soiled, folded, or torn.

In the above example, identification of the authenticity of banknotes is performed three times in the deposit machine, the counting machine, and the sorting machine. Generally, the authenticity is identified by using a recognition set value that is set for each device. Therefore, the identification results with respect to the same banknote do not always match with each other.

The authenticity of banknotes is generally identified based on a magnitude relation of a detection signal for detecting predetermined characteristic of a banknote with respect to a preset recognition set value. The recognition set value is generally set beforehand with respect to predetermined characteristics of a new banknote. Therefore, when the authenticity of an old banknote or a soiled banknote is identified, for example, even if the banknote is identified as authentic in the deposit machine, in the counting machine, the detection signal does not sufficiently reflect the predetermined characteristics of the banknote as compared with a new banknote and does not exceed the recognition set value, and thus the banknote may be identified as counterfeit, even if the banknote is authentic.

For such a banknote, since the detection signal is identified as counterfeit near the recognition set value, if identification is repeated many times through the device, the banknote may be frequently identified as authentic. Therefore, a person in charge of the device tries to verify a banknote, even if it has been identified as counterfeit and rejected once. Accordingly, since the identification operation is repeated until the banknote is identified as authentic, the labor and time therefor increases to decrease the productivity.

As described above, the plurality of paper sheet identification devices installed in respective shops, cash centers, and the like are operated to perform the identification work of banknotes respectively. However, the banknotes identified near the recognition set value decrease the productivity in all the processes.

This is considered to be caused because the identification results of the device in the previous process is not taken over by the device in the post-process. As a result, even if a banknote has been identified once as authentic by the device in the previous process, the device in the post-process identifies the authenticity of the banknote again, regardless of the identification result of the device in the previous process. Therefore, the productivity cannot be improved.

Therefore, the present inventors have arrived at a paper sheet identification system that can avoid such a state as much as possible that identification results with respect to a same paper sheet become different in a case where paper sheets such as banknotes are transferred from a device to another device, by enabling to use an identification result obtained by a device in a previous process by a device in a post-process.

Embodiment

An embodiment of the present invention is described below with reference to the accompanying drawings. In the respective drawings, like constituent elements are denoted by like reference signs and detailed descriptions thereof will be omitted as appropriate.

(Configuration)

FIG. 1 is a block diagram schematically illustrating a configuration example of a banknote identification system 10 according to the present embodiment. As illustrated in FIG. 1, the banknote identification system 10 according to the present embodiment includes a deposit machine 100, a server device 200, a counting machine 300, and a sorting machine 400. The deposit machine 100 is installed in respective shops of, for example, distribution industry. The server device 200, the counting machine 300, and the sorting machine 400 are installed in, for example, a cash center of distribution industry.

The deposit machine 100 identifies the authenticity of banknotes paid by a customer who comes to a shop and manages the number of banknotes and the like. The banknotes identified as authentic by the deposit machine 100 are transferred to the cash center. The counting machine 300 identifies the authenticity of the banknotes transferred from the shop and manages the number of banknotes and the like. The sorting machine 400 identifies the authenticity of the banknotes identified as authentic by the counting machine 300, judges the fitness thereof, and stores therein the banknotes by denomination. The server device 200 manages identification results and the like of the banknotes. The server device 200 is configured by a computer, for example, a personal computer.

The deposit machine 100, the server device 200, the counting machine 300, and the sorting machine 400 are respectively connected to a network 20. The network 20 can include, for example, a wired or wireless local area network (LAN), and can include the Internet.

The deposit machine 100 and the server device 200 are configured to be able to communicate with each other, for example, via the Internet of the network 20. The counting machine 300 and the sorting machine 400, and the server device 200 are configured to be able to communicate with each other, for example, via the LAN of the network 20.

Figure 2:
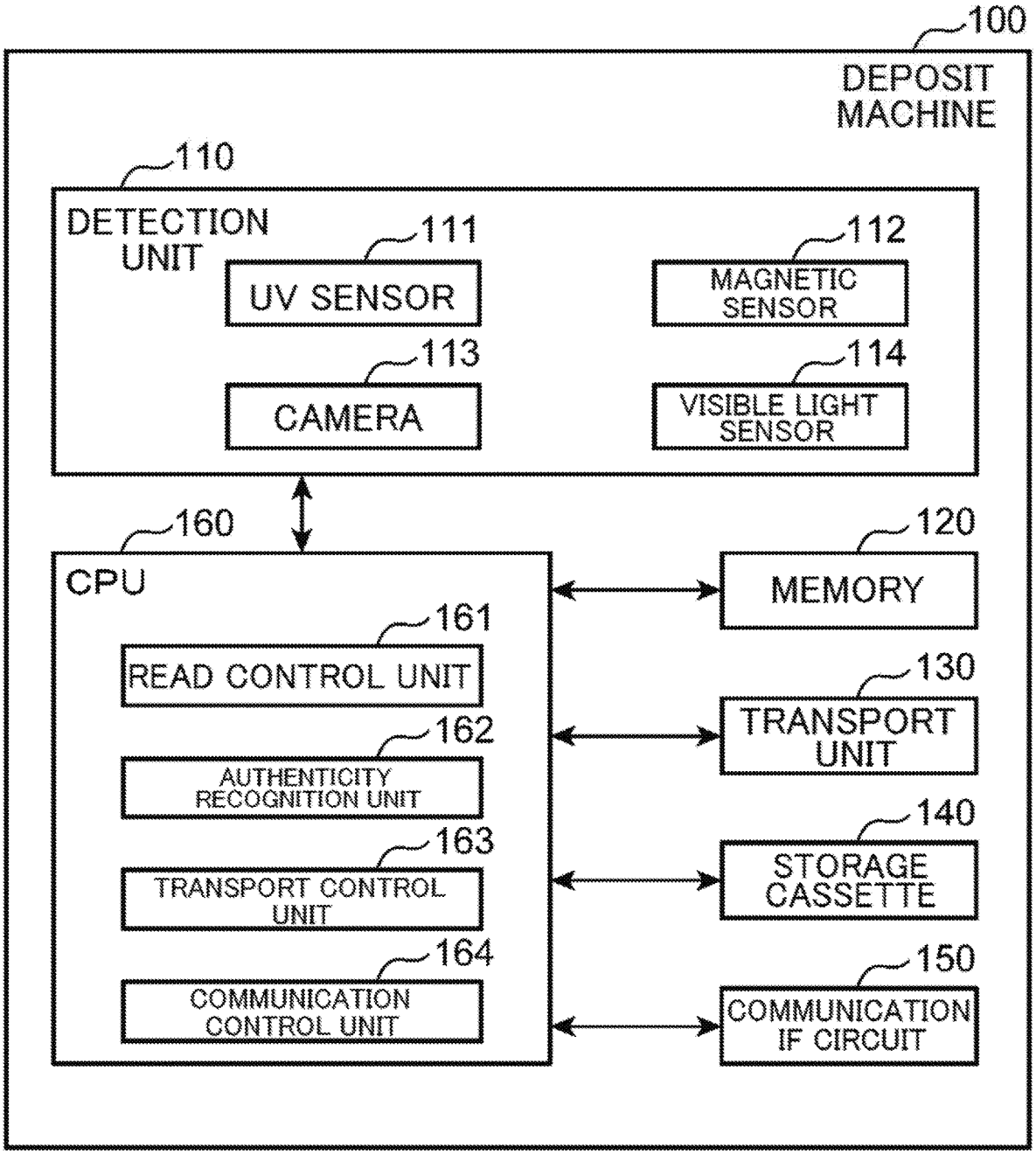
FIG. 2 is a block diagram schematically illustrating a configuration example of a deposit machine.
Figure 3:
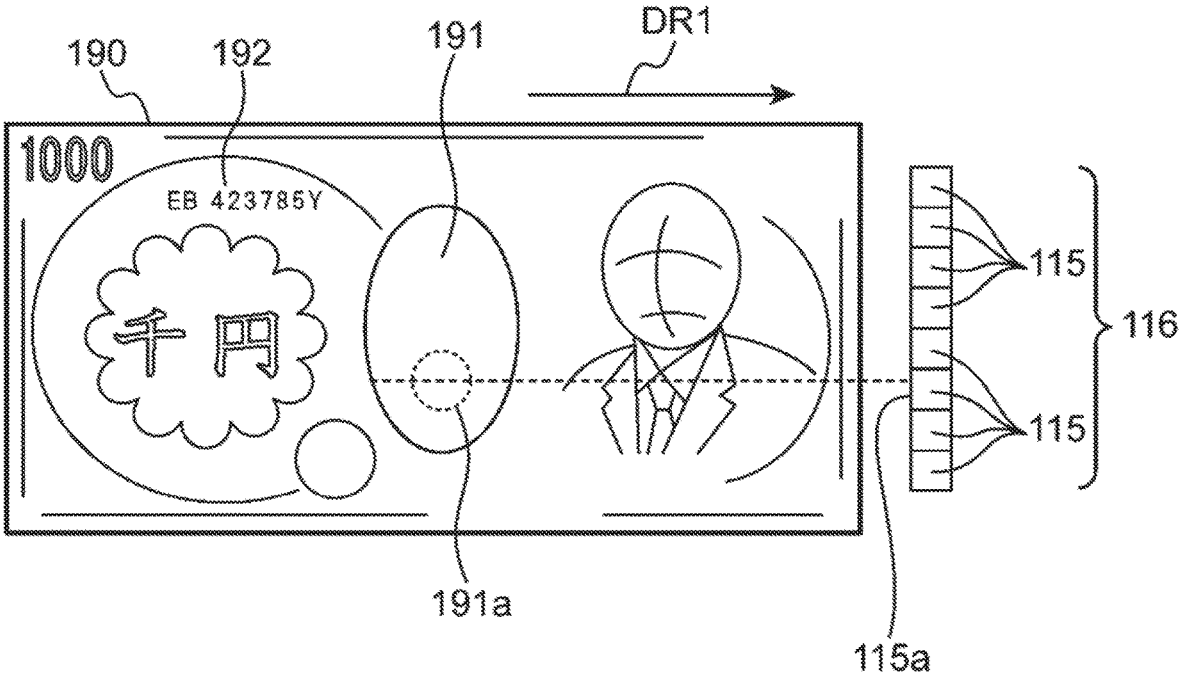
FIG. 3 is a diagram schematically illustrating a light-receiving element array and a transferred banknote.

FIG. 2 is a block diagram schematically illustrating a configuration example of the deposit machine 100 included in the banknote identification system 10 in FIG. 1. FIG. 3 is a diagram schematically illustrating a light-receiving element array 116 arranged close to a transport path of banknotes 190, and a transferred banknote 190.

As illustrated in FIG. 2, the deposit machine 100 includes a detection unit 110, a memory 120, a transport unit 130, a storage cassette 140, a communication interface (IF) circuit 150, and a central processing unit (CPU) 160. The detection unit 110 includes an ultraviolet (UV) sensor 111, a magnetic sensor 112, a camera 113, and a visible light sensor 114.

The memory 120 is configured by, for example, a semiconductor memory. The memory 120 includes, for example, a read only memory (ROM), a random access memory (RAM), and an electrically erasable programmable ROM (EEPROM). The ROM of the memory 120 memorizes therein a control program of the present embodiment that causes the CPU 160 to operate. The CPU 160 operates according to the control program of the present embodiment memorized in the memory 120, thereby to function as a read control unit 161, an authenticity recognition unit 162, a transport control unit 163, and a communication control unit 164. The respective functions of the CPU 160 are described later.

The transport unit 130 is connected to the CPU 160 and is controlled by the transport control unit 163 to operate. The transport unit 130 includes a motor for transporting banknotes along a transport path, a sensor that detects a banknote that passes the transport path, and the like. The transport unit 130 delivers the banknotes one by one from a bundle of banknotes stacked in a slot and transports the banknotes to the detection unit 110. The transport unit 130 transports banknotes identified as authentic, of the banknotes having passed through the detection unit 110, to the storage cassette 140, and transports banknotes identified as counterfeit to a reject unit (not illustrated) provided separately from the storage cassette 140.

The storage cassette 140 stores therein banknotes identified as authentic. The storage cassette 140 is connected to the CPU 160 and includes a full-filling sensor (not illustrated) that detects that the storage cassette 140 has become full of banknotes to be stored. When the full-filling sensor detects that the storage cassette 140 has become full of stored banknotes, the CPU 160 stops transport of banknotes by the transport unit 130. The storage cassette 140 can be configured to be removable from the deposit machine 100. In this case, the banknotes can be transferred in a state stored in the storage cassette 140.

The communication IF circuit 150 is connected to the CPU 160 and operates under control of the communication control unit 164. The communication IF circuit 150 communicates with the server device 200 via the network 20. The communication IF circuit 150 generates a communication signal storing therein previous process data (described later) to be transmitted, which has been input from the communication control unit 164 of the CPU 160, according to a communication protocol used in the network 20. The communication IF circuit 150 transmits the generated communication signal to the server device 200 via the network 20.

The UV sensor 111 of the detection unit 110 includes a light-emitting element that irradiates ultraviolet light toward a banknote and a light-receiving element that receives reflected light of the ultraviolet light that is reflected by the banknote. The UV sensor 111 outputs an ultraviolet light signal corresponding to the reflected light received by the light-receiving element to the CPU 160. The magnetic sensor 112 of the detection unit 110 detects magnetism output from the banknote transported by the transport unit 130 and outputs a magnetic signal corresponding to the detected magnetism to the CPU 160. The camera 113 of the detection unit 110 takes an image of the banknote and outputs an imaging signal acquired by taking the image to the CPU 160.

The visible light sensor 114 of the detection unit 110 includes, as illustrated in FIG. 3, the light-receiving element array 116 including a plurality (eight in the present embodiment, for example) of light-receiving elements 115 (photodiodes in the present embodiment, for example) and a light-emitting element array (not illustrated) including a plurality (eight in the present embodiment, for example) of light-emitting elements (light-emitting diodes in the present embodiment, for example). The light-receiving element array 116 and the light-emitting element array are respectively arranged on one side and the other side of the banknote 190, putting the banknote 190 transported by the transport unit 130 therebetween.

The light-receiving element array 116 has a length that covers a watermark region 191 provided in the banknote 190. The plurality of light-receiving elements 115 included in the light-receiving element array 116 are arranged in a direction orthogonal to a transport direction DR1 of the banknote 190. The respective light-emitting elements included in the light-emitting element array are arranged at positions facing the respective light-receiving elements 115 included in the light-receiving element array 116. The respective light-receiving elements 115 included in the light-receiving element array 116 receive transmitted light, which is light output from the respective light-emitting elements included in the light-emitting element array and transmitted through the banknote 190, and output a visible light signal corresponding to the received transmitted light to the CPU 160.

The read control unit 161 of the CPU 160 performs image processing to the imaging signal output from the camera 113 to read a serial number 192 (FIG. 3) formed by alphanumeric characters. The serial number 192 represents a sequential serial number of a banknote. Therefore, by reading the serial number 192 (corresponding to an example of a specific code), a banknote can be specified.

The authenticity recognition unit 162 of the CPU 160 identifies the authenticity of a banknote transported by the transport unit 130 based on an ultraviolet light signal output from the UV sensor 111, a magnetic signal output from the magnetic sensor 112, and a visible light signal output from the visible light sensor 114. The authenticity recognition unit 162 generates the previous process data in which an authenticity identification result is associated with the serial number read by the read control unit 161 from the banknote to be identified, and stores the generated previous process data in the memory 120. The authenticity recognition unit 162 notifies the transport control unit 163 of the authenticity recognition result.

Upon operation of a start switch provided on, for example, an external surface of the deposit machine 100, the transport control unit 163 causes the transport unit 130 to start operation, and delivers the banknotes stacked in the slot one by one and transports the banknotes to the detection unit 110. When the banknote transported to the detection unit 110 is identified as authentic by the authenticity recognition unit 162, the transport control unit 163 transports the banknote to the storage cassette 140. When the banknote transported to the detection unit 110 is identified as counterfeit by the authenticity recognition unit 162, the transport control unit 163 transports the banknote to the reject unit (not illustrated) along the transport path diverted from the transport path to the storage cassette 140.

Figure 4:
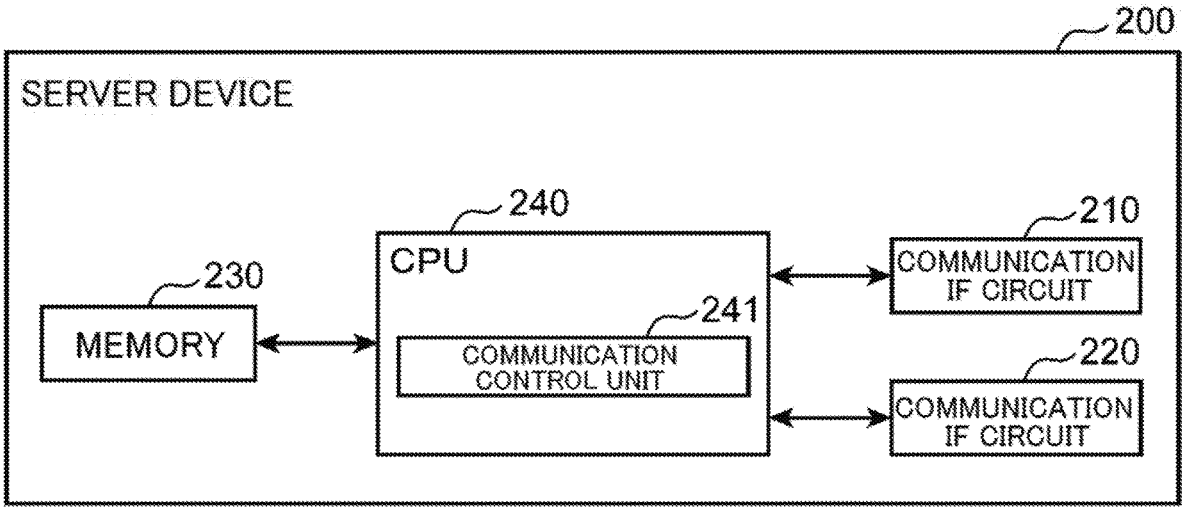
FIG. 4 is a block diagram schematically illustrating a configuration example of a server device.

FIG. 4 is a block diagram schematically illustrating a configuration example of the server device 200 included in the banknote identification system 10 in FIG. 1. The server device 200 manages identification data of banknotes transmitted from the deposit machine 100. The server device 200 includes, as illustrated in FIG. 4, communication IF circuits 210 and 220, a memory 230, and a CPU 240. The CPU 240 includes a communication control unit 241.

The communication IF circuits 210 and 220 are connected to the CPU 240 to operate under control of the communication control unit 241 of the CPU 240. The communication IF circuit 210 receives a communication signal transmitted from the deposit machine 100 via the network 20. The communication IF circuit 210 retrieves the previous process data included in the received communication signal and outputs the retrieved previous process data to the CPU 240.

The communication IF circuit 220 communicates with the counting machine 300 and the sorting machine 400 via the network 20. The communication IF circuit 220 generates a communication signal storing therein the previous process data input from the CPU 240 according to a communication protocol used in the network 20. The communication IF circuit 220 transmits the generated communication signal to the counting machine 300 or the sorting machine 400 via the network 20. The communication IF circuit 220 can include a communication circuit, for example, conforming to the IEEE 802.11 standard.

The memory 230 is configured by, for example, a semiconductor memory. The memory 230 includes, for example, a ROM, a RAM, and an EEPROM. The ROM of the memory 230 memorizes therein a control program of the present embodiment that causes the CPU 240 to operate.

The CPU 240 operates according to the control program memorized in the memory 230 to function as the communication control unit 241. The communication control unit 241 stores the previous process data transmitted from the deposit machine 100 and received by the communication IF circuit 210 in the memory 230. When transmission of data corresponding to a specific serial number, of the previous process data stored in the memory 230, is requested from the counting machine 300 or the sorting machine 400, the communication control unit 241 reads out the corresponding data from the memory 230, generates a communication signal storing therein the read data, and transmits the generated communication signal to the counting machine 300 or the sorting machine 400.

Figure 5:
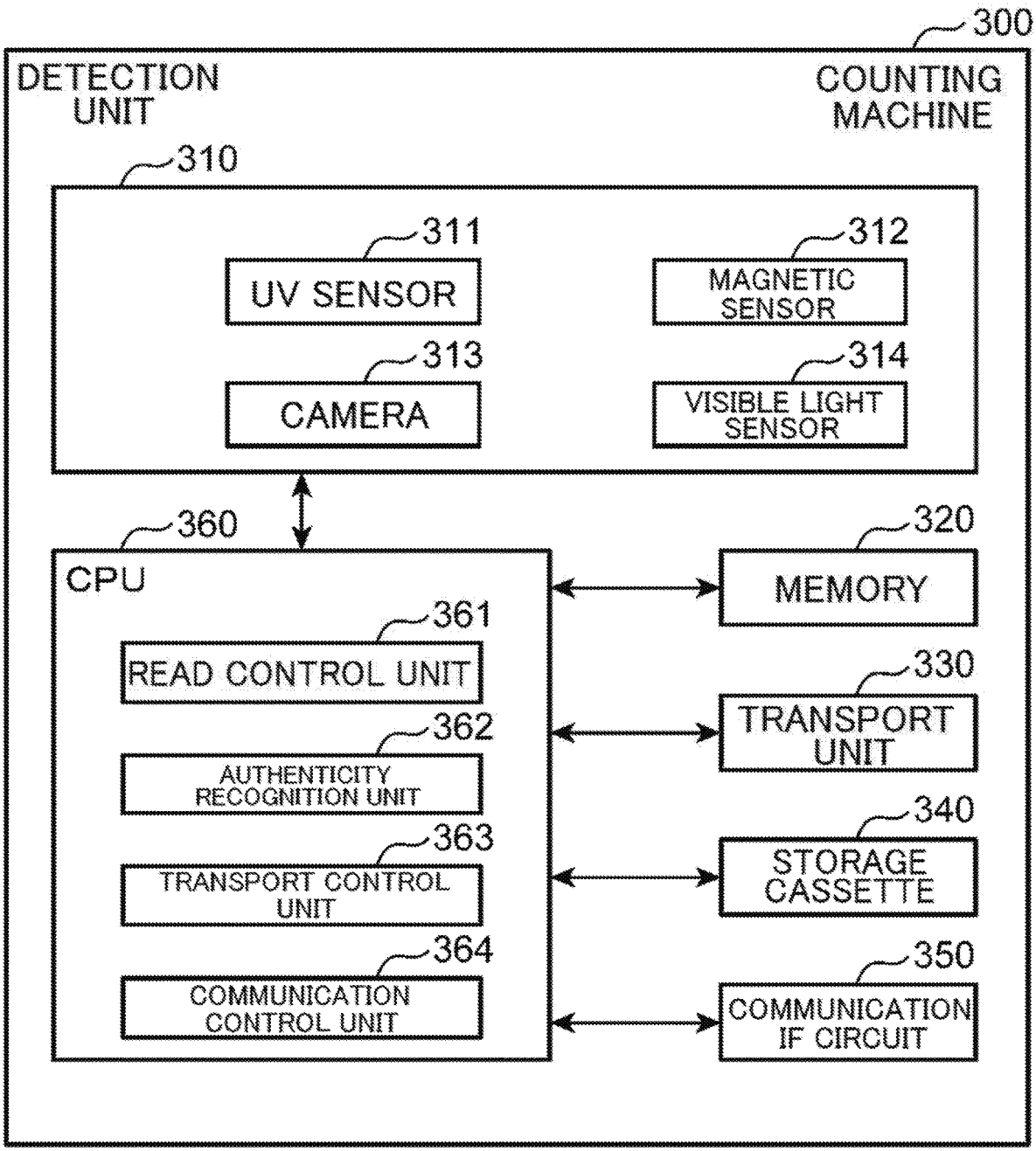
FIG. 5 is a block diagram schematically illustrating a configuration example of a counting machine.
Figure 6:
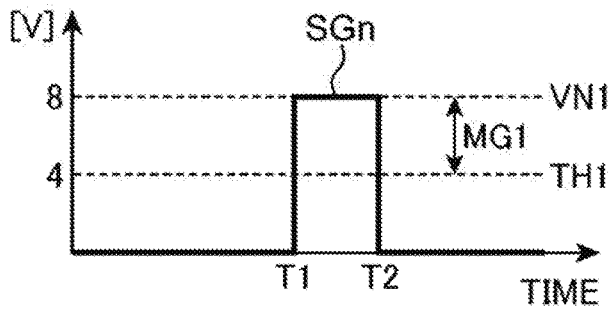
FIG. 6 is a timing chart for explaining an example of an authenticity identification method of banknotes.
Figure 6:
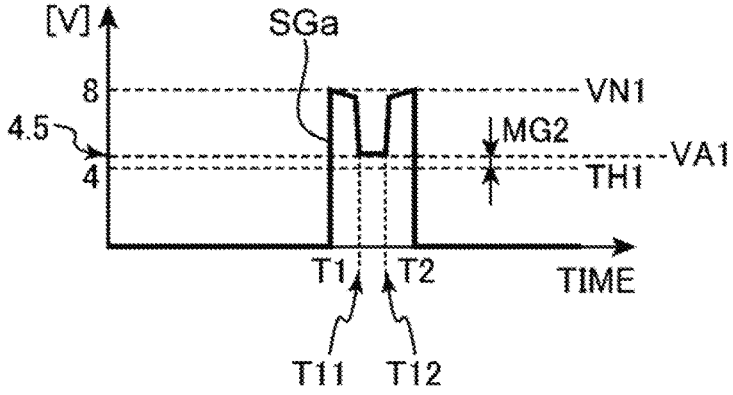
Figure 6:
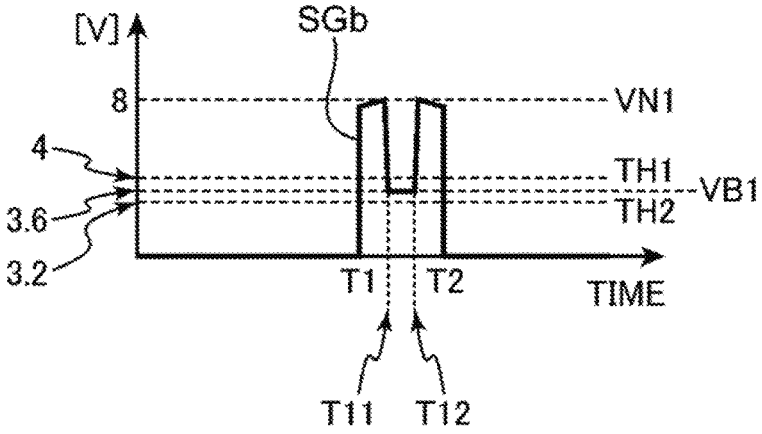

FIG. 5 is a block diagram schematically illustrating a configuration example of the counting machine 300 included in the banknote identification system 10 in FIG. 1. FIG. 6 is a timing chart for explaining an example of an authenticity identification method of banknotes in the deposit machine 100 and the counting machine 300.

As illustrated in FIG. 5, the counting machine 300 has substantially the same configuration as that of the deposit machine 100 illustrated in FIG. 2. That is, the counting machine 300 includes a detection unit 310, a memory 320, a transport unit 330, a storage unit 340, a communication IF circuit 350, and a CPU 360. The detection unit 310 includes a UV sensor 311, a magnetic sensor 312, a camera 313, and a visible light sensor 314.

The memory 320 is configured by, for example, a semiconductor memory. The memory 320 includes, for example, a ROM, a RAM, and an EEPROM. The ROM of the memory 320 memorizes therein a control program of the present embodiment that causes the CPU 360 to operate. The CPU 360 operates according to the control program of the present embodiment memorized in the memory 320, thereby to function as a read control unit 361, an authenticity recognition unit 362, a transport control unit 363, and a communication control unit 364.

The transport unit 330 functions in the same manner as the transport unit 130 (FIG. 2) of the deposit machine 100. That is, the transport unit 330 is connected to the CPU 360 and operates under control of the transport control unit 363. The storage unit 340 functions in the same manner as the storage cassette 140 (FIG. 2) of the deposit machine 100. That is, the storage unit 340 stores therein banknotes identified as authentic.

The communication IF circuit 350 is connected to the CPU 360 and operates under control of the communication control unit 364. The communication IF circuit 350 communicates with the server device 200 via the network 20. When it is detected that a bundle of banknotes are stacked, for example, in the slot at the time of starting identification of the authenticity of banknotes by the counting machine 300, the communication IF circuit 350 transmits a communication signal requesting transmission of the previous process data to the server device 200. Upon reception of a communication signal transmitted from the server device 200, the communication IF circuit 350 retrieves the previous process data from the received communication signal and outputs the retrieved previous process data to the CPU 360. The communication control unit 364 of the CPU 360 stores the previous process data in the memory 320. The communication IF circuit 350 includes a communication circuit conforming to the same communication standard as the communication IF circuit 220 (FIG. 4) of the server device 200.

The UV sensor 311, the magnetic sensor 312, the camera 313, and the visible light sensor 314 of the detection unit 310 respectively function in the same manner as the UV sensor 111, the magnetic sensor 112, the camera 113, and the visible light sensor 114 (FIG. 2) of the detection unit 110 of the deposit machine 100.

The read control unit 361 of the CPU 360 functions in the same manner as the read control unit 161 (FIG. 2) of the CPU 160 of the deposit machine 100. That is, the read control unit 361 performs image processing to an imaging signal output from the camera 313 to read a serial number formed by alphanumeric characters described on the banknote. The read control unit 361 stores the read serial number in the memory 320.

The authenticity recognition unit 362 of the CPU 360 identifies the authenticity of a banknote transported by the transport unit 330 based on an ultraviolet light signal output from the UV sensor 311, a magnetic signal output from the magnetic sensor 312, and a visible light signal output from the visible light sensor 314.

An example of the authenticity identification method in the deposit machine 100 and the counting machine 300 of the present embodiment is described with reference to FIG. 3 and FIG. 6. According to the present embodiment, the visible light sensor 114 of the deposit machine 100 and the visible light sensor 314 of the counting machine 300 have the same configuration. That is, the visible light sensor 314 of the counting machine 300 includes the light-receiving element array 116 illustrated in FIG. 3. An example of using a visible light signal output from the respective light-receiving elements 115 in the light-receiving element array 116 included in the visible light sensor 114 of the deposit machine 100 and the visible light sensor 314 of the counting machine 300 is described here as an example of the authenticity identification method. The numerical values illustrated in FIG. 6 are only examples, and needless to mention, the numerical values change according to the characteristics or the like of the visible light sensors 114 and 314.

A section (A) in FIG. 6 illustrates an example of a visible light signal SGn output from the respective light-receiving elements 115, when the watermark region 191 of the banknote 190 is clean. A section (B) in FIG. 6 illustrates an example of a visible light signal SGa output from a light-receiving element 115*a* (FIG. 3) facing a soiled region 191*a*, when there is the soiled region 191*a* (FIG. 3) in the watermark region 191 of the banknote 190, in the deposit machine 100. A section (C) in FIG. 6 illustrates an example of a visible light signal SGb output from the light-receiving element 115*a* (FIG. 3) facing the soiled region 191*a*, when there is the soiled region 191*a* (FIG. 3) in the watermark region 191 of the banknote 190, in the counting machine 300.

A case where the watermark region 191 (FIG. 3) of the banknote 190 is clean in the deposit machine 100 is described first with reference to the section (A) in FIG. 6. Even if the transported banknote 190 reaches a position facing the light-receiving elements 115, the banknote 190 first blocks the light, and thus a voltage level of the visible light signal SGn does not rise. Thereafter, at a time T1 when a front end of the watermark region 191 reaches the position facing the light-receiving elements 115, the voltage level of the visible light signal SGn rises. Thereafter, at a time T2 when a rear end of the watermark region 191 reaches the position facing the light-receiving elements 115, the voltage level of the visible light signal SGn drops to return to the initial state.

As illustrated in the section (A) in FIG. 6, the visible light signal SGn rises to a voltage value VN1, which is higher than a recognition set value TH1. Therefore, the authenticity recognition unit 162 of the deposit machine 100 identifies the banknote 190 as authentic. In the example of the section (A) in FIG. 6, the voltage value VN1 is 8 [V], and the recognition set value TH1 is set to 4 [V]. Therefore, a recognition margin value MG1, which is a level difference therebetween, is 4 [V].

A case where there is the soiled region 191*a* (FIG. 3) in the watermark region 191 of the banknote 190 in the deposit machine 100 is described with reference to the section (B) in FIG. 6. Even if the transported banknote 190 reaches the position facing the light-receiving element 115*a*, the banknote 190 first blocks the light, and thus a voltage level of the visible light signal SGa does not rise. Thereafter, at the time T1 when the front end of the watermark region 191 reaches the position facing the light-receiving element 115*a*, the voltage level of the visible light signal SGa rises to the voltage level VN1 higher than the recognition set value TH1. Up to this point, it is the same as the visible light signal SGn illustrated in the section (A) in FIG. 6.

Thereafter, at a time T11 when a front end of the soiled region 191*a* (FIG. 3) of the watermark region 191 reaches the position facing the light-receiving element 115*a*, the voltage level of the visible light signal SGa drops to a voltage value VA1. Thereafter, at a time T12 when a rear end of the soiled region 191*a* (FIG. 3) of the watermark region 191 reaches the position facing the light-receiving element 115*a*, the voltage level of the visible light signal SGa rises again to the voltage value VN1. Thereafter, at the time T2 when the rear end of the watermark region 191 reaches the position facing the light-receiving elements 115, the voltage level of the visible light signal SGa drops to return to the initial state.

As illustrated in the section (B) in FIG. 6, while the voltage level of the visible light signal SGa drops from the voltage value VN1 to the voltage value VA1 at a time when the light-receiving element 115*a* faces the soiled region 191*a*, the voltage value VA1 is higher than the recognition set value TH1. Therefore, the authenticity recognition unit 162 of the deposit machine 100 identifies the banknote 190 as authentic. In the example of the section (B) in FIG. 6, the voltage value VA1 is 4.5 [V], and the recognition set value TH1 is set to 4 [V]. Therefore, a recognition margin value MG2, which is a level difference therebetween, is 0.5 [V].

A case where there is the soiled region 191*a* (FIG. 3) in the watermark region 191 of the banknote 190 in the counting machine 300 is described with reference to the section (C) in FIG. 6. It is the same as that of the section (B) in FIG. 6 that the voltage level of the visible light signal SGb rises at the time T1, drops during the time from the time T11 at which the light-receiving element 115*a* faces the soiled region 191*a* until the time T12, and then rises at the time T12 to return to the initial state at the time T2.

The different point from the section (B) in FIG. 6 is that during the time from the time T11 at which the light-receiving element 115*a* faces the soiled region 191*a* until the time T12, the voltage level of the visible light signal SGb drops to a voltage value VB1 lower than the recognition set value TH1. This is considered due to a variation in the characteristics of the light-receiving element 115*a* included in the visible light sensor 114 of the deposit machine 100 and the light-receiving element 115*a* included in the visible light sensor 314 of the counting machine 300.

Therefore, the authenticity recognition unit 362 of the counting machine 300 once identifies the banknote 190 as counterfeit, because the voltage value VB1 is lower than the recognition set value TH1.

In the present embodiment, when the authenticity recognition unit 362 identifies the banknote 190 as counterfeit, the authenticity recognition unit 362 checks whether the voltage value of the visible light signal is near the recognition set value. In other words, the authenticity recognition unit 362 checks whether a level difference between the voltage value of the visible light signal (corresponding to an example of a second detection signal) and the recognition set value (corresponding to an example of a second set value) is less than a predetermined value (15% in the present embodiment, for example, and corresponding to an example of the second threshold).

In the example of the section (C) in FIG. 6, since the voltage value VB1 of the visible light signal is 3.6 [V] and the recognition set value TH1 is 4 [V], a level difference therebetween is 0.4 [V]. Therefore, a quotient obtained by dividing the level difference by the recognition set value TH1 is 10%, which is less than 15%. As a result, the authenticity recognition unit 362 determines that a difference between the voltage value of the visible light signal and the recognition set value is less than the predetermined value.

When determining that the difference between the voltage value of the visible light signal and the recognition set value is less than the predetermined value, the authenticity recognition unit 362 acquires the recognition set value TH1 and the recognition margin value MG1 associated with the serial number of the banknote as a current identification target, from the previous process data stored in the memory 320. The authenticity recognition unit 362 determines whether a recognition margin value/recognition set value, which is a quotient obtained by dividing the acquired recognition margin value MG1 by the recognition set value TH1, is less than the predetermined value. When determining that the recognition margin value/recognition set value is less than the predetermined value, the authenticity recognition unit 362 relaxes the recognition set value TH1 to a recognition set value TH2, which is smaller than the recognition set value TH1. In the present embodiment, the authenticity recognition unit 362 sets the recognition set value TH2, for example, to be 80% of the recognition set value TH1. Therefore, in the example of the section (C) in FIG. 6, since the recognition set value TH1 is 4 [V], the recognition set value TH2 becomes 3.2 [V].

The authenticity recognition unit 362 compares the voltage value VB1 with the relaxed recognition set value TH2 to identify the authenticity of the banknote 190. In the example of the section (C) in FIG. 6, since the voltage value VB1 is 3.6 [V] and the recognition set value TH2 is 3.2 [V], the authenticity recognition unit 362 identifies the banknote 190 as authentic.

The recognition set value TH1 in the sections (A) and (B) in FIG. 6 (corresponding to an example of a first set value) is preset and memorized in the memory 120. The recognition set value TH1 in the section (C) in FIG. 6 (corresponding to an example of the second set value) is preset and memorized in the memory 320.

Referring back to FIG. 5, the transport control unit 363 of the CPU 360 functions in the same manner as the transport control unit 163 (FIG. 2) of the deposit machine 100. That is, the transport control unit 363 controls the operation of the transport unit 330 to control transport of the banknote 190. The communication control unit 364 of the CPU 360 functions in the same manner as the communication control unit 241 (FIG. 4) that controls the communication IF circuit 220 of the server device 200. That is, the communication control unit 364 controls the operation of the communication IF circuit 350 to control the communication with the server device 200.

Figure 7:
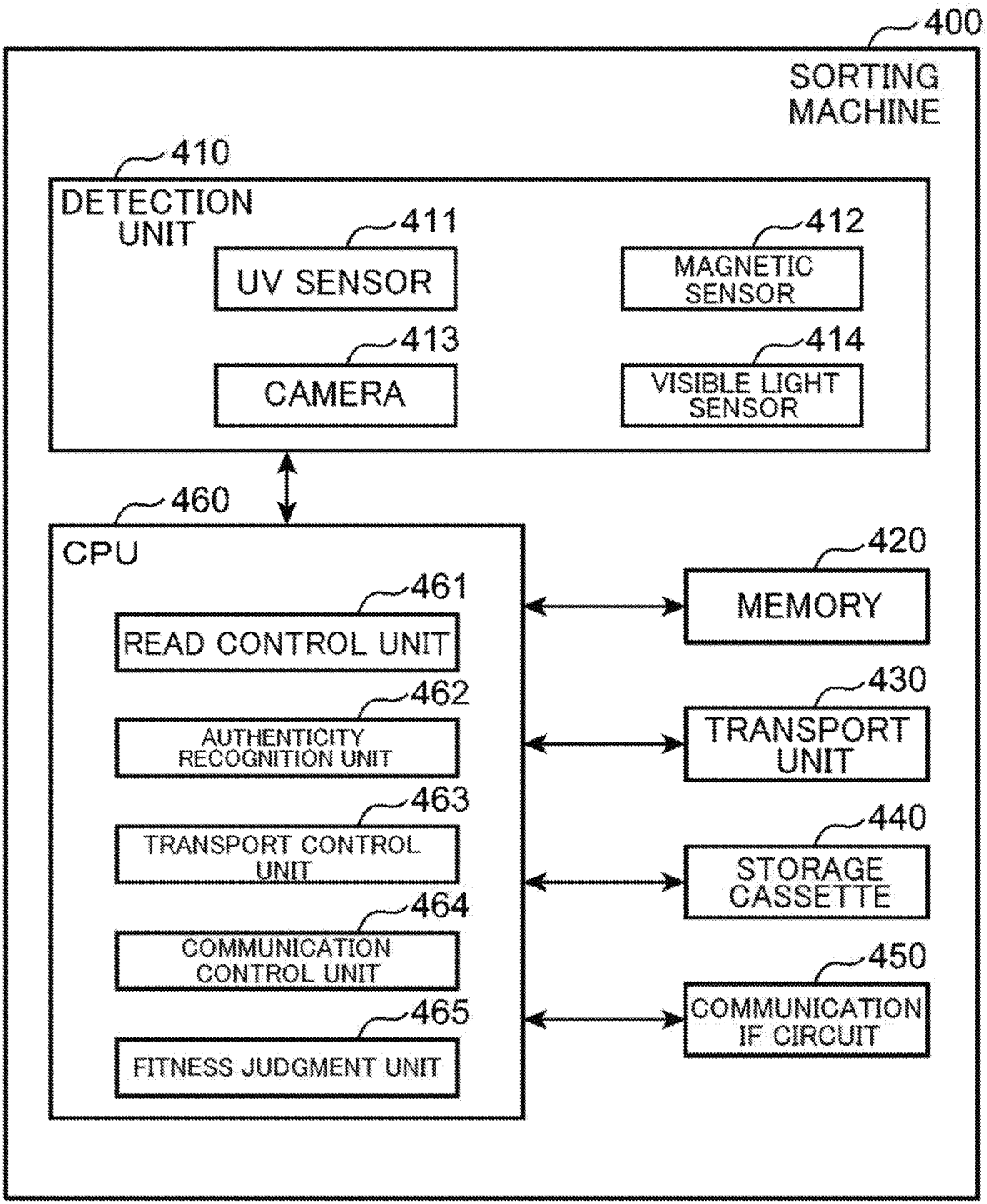
FIG. 7 is a block diagram schematically illustrating a configuration example of a sorting machine.

FIG. 7 is a block diagram schematically illustrating a configuration example of the sorting machine 400 included in the banknote identification system 10 in FIG. 1. As illustrated in FIG. 7, the sorting machine 400 has substantially the same configuration as that of the deposit machine 100 (FIG. 2) or the counting machine 300 (FIG. 5). That is, the sorting machine 400 includes a detection unit 410, a memory 420, a transport unit 430, a storage unit 440, a communication IF circuit 450, and a CPU 460. The detection unit 410 includes a UV sensor 411, a magnetic sensor 412, a camera 413, and a visible light sensor 414.

The memory 420 is configured by, for example, a semiconductor memory. The memory 420 includes, for example, a ROM, a RAM, and an EEPROM. The ROM of the memory 420 memorizes therein a control program of the present embodiment that causes the CPU 460 to operate. The CPU 460 operates according to the control program of the present embodiment memorized in the memory 420, thereby to function as a read control unit 461, an authenticity recognition unit 462, a transport control unit 463, a communication control unit 464, and a fitness judgment unit 465.

The transport unit 430 functions in the same manner as the transport unit 330 (FIG. 5) of the counting machine 300. That is, the transport unit 430 is connected to the CPU 460 and operates under control of the transport control unit 463. The storage unit 440 functions in the same manner as the storage unit 340 (FIG. 5) of the counting machine 300. That is, the storage unit 440 stores therein banknotes identified as authentic.

The communication IF circuit 450 is connected to the CPU 460 and controlled by the communication control unit 464 to operate in the same manner as the communication IF circuit 350 (FIG. 5) of the counting machine 300. That is, the communication IF circuit 450 communicates with the server device 200 via the network 20. When it is detected that a bundle of banknotes are stacked, for example, in the slot at the time of starting identification of the authenticity of banknotes by the sorting machine 400, the communication IF circuit 450 transmits a communication signal requesting transmission of the previous process data to the server device 200. Upon reception of a communication signal transmitted from the server device 200, the communication IF circuit 450 retrieves the previous process data from the received communication signal and outputs the retrieved previous process data to the CPU 460. The communication control unit 464 of the CPU 460 stores the previous process data in the memory 420. The communication IF circuit 450 includes a communication circuit conforming to the same communication standards as the communication IF circuit 220 (FIG. 4) of the server device 200.

The UV sensor 411, the magnetic sensor 412, the camera 413, and the visible light sensor 414 of the detection unit 410 respectively function in the same manner as the UV sensor 111, the magnetic sensor 112, the camera 113, and the visible light sensor 114 (FIG. 2) of the detection unit 110 of the deposit machine 100.

The read control unit 461 of the CPU 460 functions in the same manner as the read control unit 161 (FIG. 2) of the CPU 160 of the deposit machine 100. The authenticity recognition unit 462 of the CPU 460 functions in the same manner as the authenticity recognition unit 362 (FIG. 5) of the CPU 360 of the counting machine 300. The transport control unit 463 of the CPU 460 functions in the same manner as the transport control unit 363 (FIG. 5) of the counting machine 300. The communication control unit 464 of the CPU 460 functions in the same manner as the communication control unit 364 (FIG. 5) of the counting machine 300.

The fitness judgment unit 465 of the CPU 460 performs fitness judgment of the banknote 190 (FIG. 3). The fitness judgment refers to judging the banknotes identified as authentic as a fit note in a good condition, or as an unfit note having damages such as being soiled, folded, or torn. The sorting machine 400 can be configured to store the fit notes and the unfit notes in separate storage cassettes respectively.

In the present embodiment, the deposit machine 100 corresponds to an example of a first paper sheet identification device, the counting machine 300 corresponds to an example of a second paper sheet identification device, and the sorting machine 400 corresponds to an example of a third paper sheet identification device. The camera 113 and the read control unit 161 correspond to an example of a first read unit, the camera 313 and the read control unit 361 correspond to an example of a second read unit, and the camera 413 and the read control unit 461 correspond to an example of a third read unit. The UV sensor 111, the magnetic sensor 112, the visible light sensor 114, and the authenticity recognition unit 162 correspond to an example of a first identification unit. The UV sensor 311, the magnetic sensor 312, the visible light sensor 314, and the authenticity recognition unit 362 correspond to an example of a second identification unit. The UV sensor 411, the magnetic sensor 412, the visible light sensor 414, and the authenticity recognition unit 462 correspond to an example of a third identification unit. The storage cassette 140 corresponds to an example of a first storage unit, the storage unit 340 corresponds to an example of a second storage unit, and the storage unit 440 corresponds to an example of a third storage unit. The communication IF circuit 150 and the communication control unit 164 correspond to an example of a first communication unit, the communication IF circuit 350 and the communication control unit 364 correspond to an example of a first acquisition unit, and the communication IF circuit 450 and the communication control unit 464 correspond to an example of a second acquisition unit. The server device 200 corresponds to an example of an identified data management device, the communication IF circuits 210, 220, and the communication control unit 241 correspond to an example of a management communication unit, and the memory 230 corresponds to an example of a management memory unit.

(Operation Example of Deposit Machine)

Figure 8:
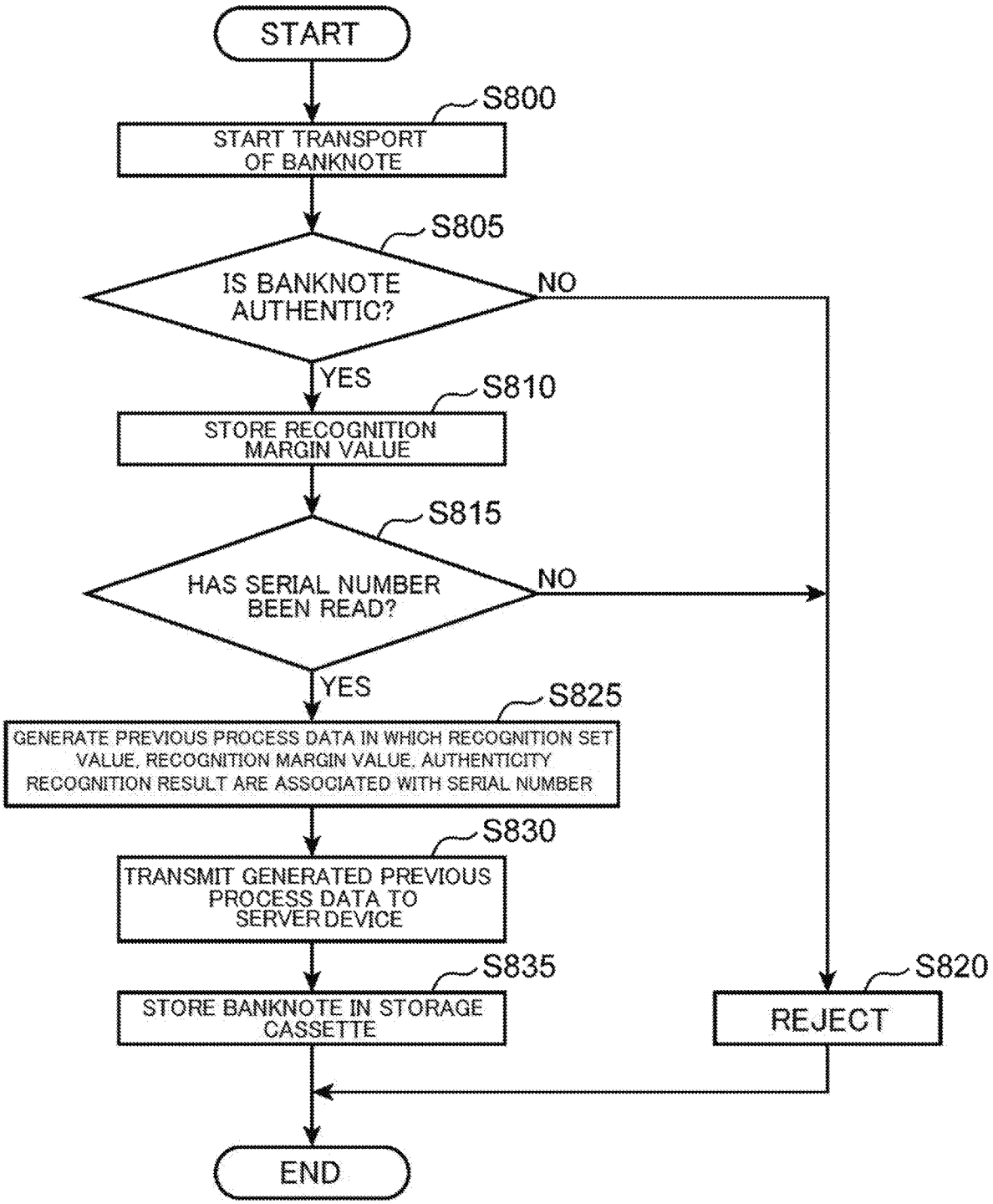
FIG. 8 is a flowchart schematically illustrating an operation example of the deposit machine.

FIG. 8 is a flowchart schematically illustrating an operation example of the deposit machine 100. For example, when a bundle of banknotes is set in the slot of the deposit machine 100, an operation illustrated in FIG. 8 is started. Thereafter, the operation in FIG. 8 is repeatedly performed until there is no bundle of banknotes set in the slot.

At step S800, the transport control unit 163 controls the operation of the transport unit 130 to start transport of banknotes. At step S805, the authenticity recognition unit 162 identifies whether the banknote is authentic. For example, the authenticity recognition unit 162 compares a voltage value of a visible light signal output from the visible light sensor 114 (corresponding to an example of the first detection signal) with the recognition set value TH1 (corresponding to an example of the first set value), and identifies the banknote as authentic if the voltage value of the visible light signal exceeds the recognition set value TH1.

If the banknote is counterfeit (NO at step S805), process proceeds to step S820. On the other hand, if the banknote is authentic (YES at step S805), the process proceeds to step S810. At step S810, the authenticity recognition unit 162 stores the recognition margin value MG1 (FIG. 6) acquired by the process at step S805 in the memory 120.

At step S815, the read control unit 161 judges whether the serial number 192 (FIG. 3) has been read. If the serial number 192 has not been read (NO at step S815), the process proceeds to step S820. At step S820, the transport control unit 163 switches a transport destination of the banknote to transport the banknote to the reject unit, and deletes the recognition margin value MG1 stored in the memory 120 at step S805 from the memory 120.

On the other hand, if the serial number 192 has been read (YES at step S815), the process proceeds to step S825. At step S825, the authenticity recognition unit 162 generates previous process data in which the recognition set value TH1, the recognition margin value MG1, and an authenticity identification result are associated with the serial number 192. At step S830, the communication control unit 164 controls the operation of the communication IF circuit 150 to transmit the generated previous process data to the server device 200 via the network 20. At step S835, the transport control unit 163 stores the banknote in the storage cassette 140.

(Operation Example of Counting Machine)

Figure 9:
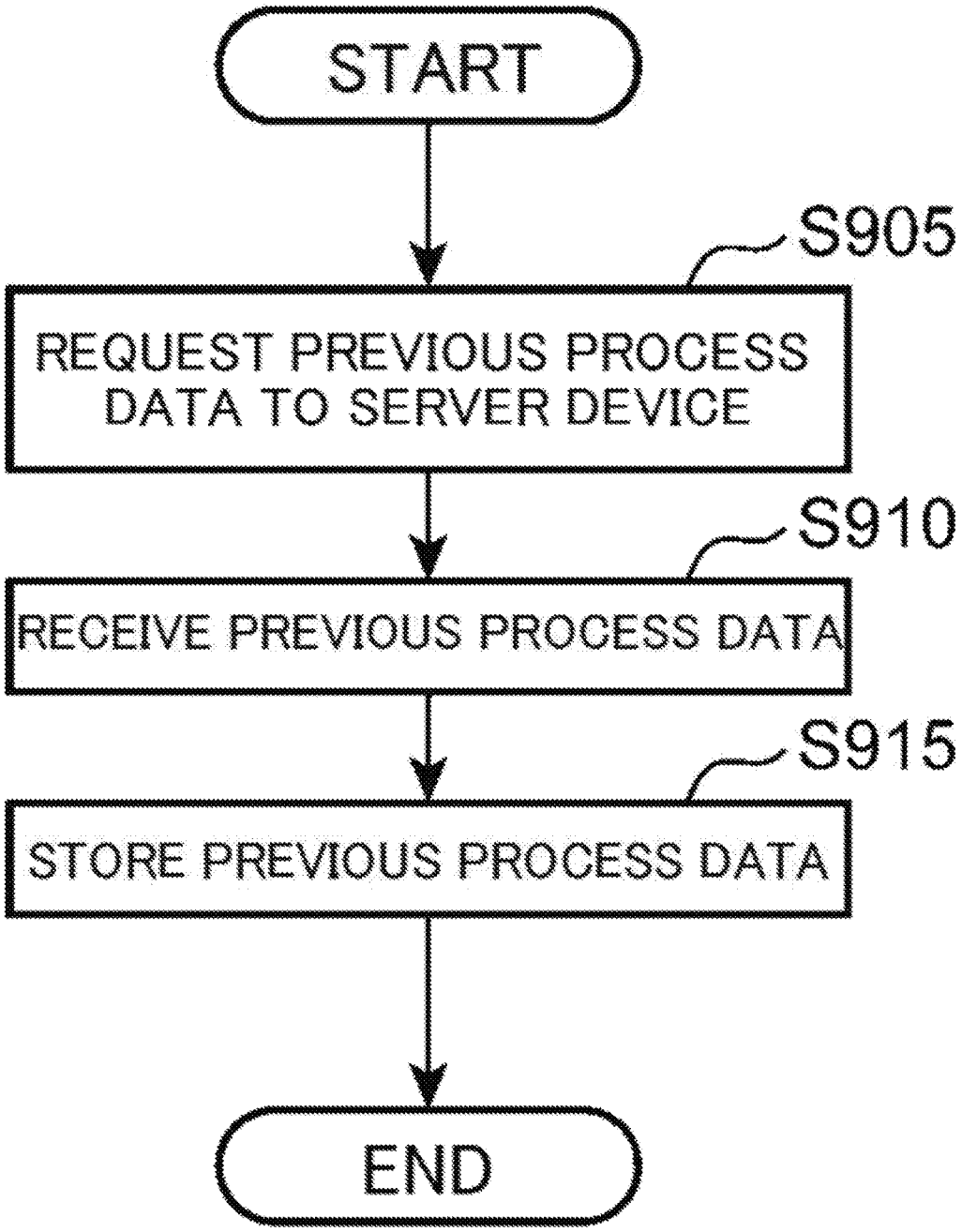
FIG. 9 is a flowchart schematically illustrating an example of a previous process-data acquisition procedure in the counting machine.

FIG. 9 is a flowchart schematically illustrating an example of a previous process-data acquisition procedure in the counting machine 300. For example, when a bundle of banknotes is newly set in the slot of the counting machine 300, an operation in FIG. 9 is started automatically, or upon operation of a start switch provided in the counting machine 300, the operation in FIG. 9 is started.

At step S905, the communication control unit 364 transmits a communication signal requesting the previous process data to the server device 200. At step S910, the communication control unit 364 receives the previous process data transmitted from the server device 200. At step S915, the communication control unit 364 stores the received previous process data in the memory 320. Thereafter, the processing in FIG. 9 ends.

Figure 10:
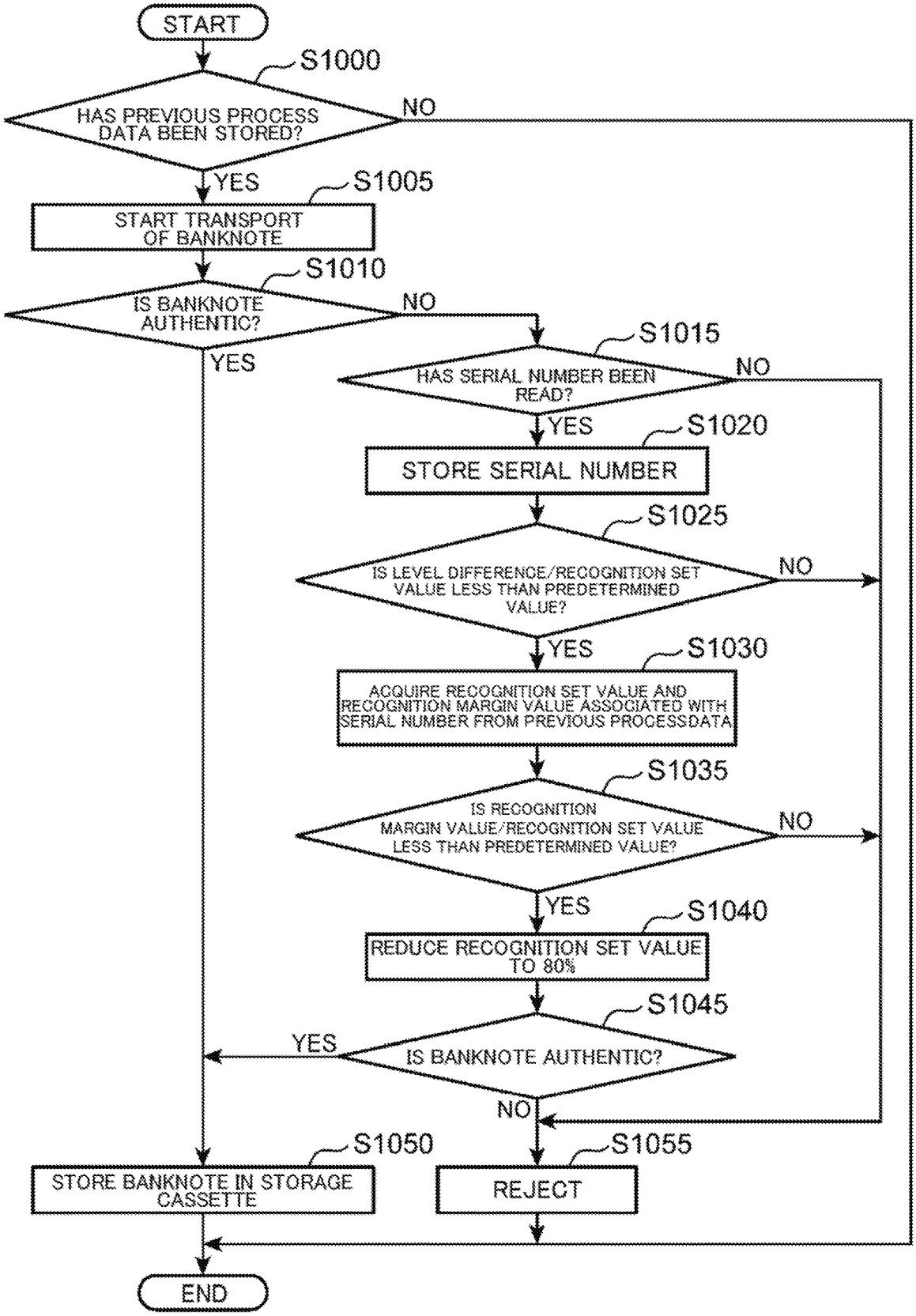
FIG. 10 is a flowchart schematically illustrating an operation example of the counting machine.

FIG. 10 is a flowchart schematically illustrating an operation example of the counting machine 300. At step S1000, the CPU 360 judges whether the previous process data has been stored in the memory 320 by the operation in FIG. 9. If the previous process data has not been stored in the memory 320 (NO at step S1000), the processing in FIG. 10 ends. On the other hand, if the previous process data has been stored in the memory 320 (YES at step S1000), the process proceeds to step S1005.

At step S1005, the transport control unit 363 controls the operation of the transport unit 330 to start transport of banknotes. At step S1010, the authenticity recognition unit 362 identifies whether the banknote is authentic. If the banknote is authentic (YES at step S1010), the process proceeds to step S1050. On the other hand, if the banknote is not authentic (NO at step S1010), the process proceeds to step S1015.

At step S1015, the read control unit 361 judges whether the serial number 192 (FIG. 3) has been read. If the serial number 192 has not been read (NO at step S1015), the process proceeds to step S1055. On the other hand, if the serial number 192 has been read (YES at step S1015), the process proceeds to step S1020. At step S1020, the read control unit 361 stores the serial number 192 (FIG. 3) read by the process at step S1015 in the memory 320.

At step S1025, the authenticity recognition unit 362 judges whether a level difference/recognition set value, which is a quotient obtained by dividing a level difference between the visible light signal at step S1010 and the recognition set value TH1 by the recognition set value TH1, is less than a predetermined value (15% in the present embodiment, for example). If the level difference/recognition set value is equal to or larger than the predetermined value (NO at step S1025), the process proceeds to step S1055. On the other hand, if the level difference/recognition set value is less than the predetermined value (YES at step S1025), the process proceeds to step S1030.

At step S1030, the authenticity recognition unit 362 acquires the recognition set value TH1 and the recognition margin value MG1 (corresponding to an example of the level difference and corresponding to an example of a first level difference) associated with the serial number stored in the memory 320 at step S1020, from the previous process data stored in the memory 320. At step S1035, the authenticity recognition unit 362 judges whether the recognition margin value/recognition set value, which is a quotient obtained by dividing the recognition margin value MG1 by the recognition set value TH1, acquired at step S1030, is less than the predetermined value (15% in the present embodiment, for example, and corresponding to an example of a first threshold). If the recognition margin value/recognition set value is equal to or larger than the predetermined value (NO at step S1035), the process proceeds to step S1055. On the other hand, if the recognition margin value/recognition set value is less than the predetermined value (YES at step S1035), the process proceeds to step S1040.

At step S1040, the authenticity recognition unit 362 generates a recognition set value TH2, which is a value relaxing the recognition set value TH1 of the counting machine 300 to 80%. At step S1045, the authenticity recognition unit 362 compares the relaxed recognition set value TH2 with the recognition result acquired at step S1010 to identify whether the banknote is authentic. If the banknote is authentic (YES at step S1045), the process proceeds to step S1050. On the other hand, if the banknote is not authentic (NO at step S1045), the process proceeds to step S1055.

At step S1050, the transport control unit 163 stores the banknote in the storage unit 340 to end the processing in FIG. 10. At step S1055, the transport control unit 163 switches a transport destination of the banknote to transport the banknote to the reject unit, and deletes the serial number 192 stored in the memory 320 at step S1020 from the memory 320, to end the processing in FIG. 10.

(Effects)

As described above, the paper sheet identification device (the counting machine 300) of the present embodiment includes the identification unit (the UV sensor 311, the magnetic sensor 312, the visible light sensor 314, and the authenticity recognition unit 362) that identifies a paper sheet. The paper sheet identification device also includes the memory (the memory 320) that memorizes therein specific information (the recognition margin value MG) acquired when another device (the deposit machine 100) has identified the paper sheet, and the condition relaxing unit (the authenticity recognition unit 362) that can relax conditions for judgment that the paper sheet is authentic according to the specific information. Further, the paper sheet identification device (the deposit machine 100) of the present embodiment includes the read unit (the camera 113 and the read control unit 16) that reads a specific code described on a surface of a paper sheet to uniquely specify the paper sheet, and the identification unit (the UV sensor 111, the magnetic sensor 112, the visible light sensor 114, and the authenticity recognition unit 162) that identifies a paper sheet, and the generation unit (the authenticity recognition unit 162) that generates previous process data in which the specific information (the recognition margin value MG) acquired when the paper sheet is identified and the specific code of the paper sheet are associated with each other. If a banknote with the serial number 192 is identified as counterfeit in the counting machine 300, the counting machine 300 is configured so as to be able to acquire the recognition set value TH1 and the recognition margin value MG1 when the banknote is identified as authentic in the deposit machine 100. If the recognition margin value/recognition set value is less than a predetermined value, the recognition set value TH1 is relaxed to 80% as the recognition set value TH2. Therefore, according to the present embodiment, in the deposit machine 100 and the counting machine 300, such a state that the authenticity identification results with respect to the same banknote 190 become different can be avoided as much as possible.

In the deposit machine 100, when it is identified that the recognition margin value/recognition set value is less than the predetermined value, that is, the banknote 190 is identified as authentic near the recognition set value (YES at step S1035), the recognition set value is relaxed in the counting machine 300 (step S1040). Therefore, in the counting machine 300, the frequency that the banknote 190 is identified as counterfeit decreases. As a result, the identification work does not need to be repeated until the banknote 190 is identified as authentic, thereby enabling to reduce man-hours required for the identification work.

Modified Embodiment (1) In the procedure in FIG. 8 according to the above embodiment, the operation in FIG. 8 is repeatedly performed after the banknote is stored in the storage cassette 140. However, the procedure is not limited thereto. It can be configured such that the operation in FIG. 8 for the next banknote is started at a timing at which the banknote does not overlap on the banknote transported previously.

(2) In the procedure in FIG. 8 according to the above embodiment, the previous process data is transmitted to the server device 200 every time the authenticity of a banknote is identified. However, the procedure is not limited thereto. It can be configured such that the previous process data of all the banknotes is transmitted to the server device 200 after the authenticity identification of all the banknotes stacked in the slot is finished.

(3) In the procedure in FIG. 10 according to the above embodiment, the operation in FIG. 10 is repeatedly performed after the banknote is stored in the storage unit 340. However, the procedure is not limited thereto. It can be configured such that the operation in FIG. 10 for the next banknote is started at a timing at which the banknote does not overlap on the banknote transported previously.

(4) In the procedure in FIG. 10 according to the above embodiment, step S1025 is added to configure the procedure such that only when the level difference/recognition set value is less than a predetermined value, that is, the banknote 190 is identified as counterfeit near the recognition set value (YES at step S1025), the previous process data is acquired (step S1030). However, the configuration is not limited thereto. It can be configured such that step S1025 is omitted, and if the banknote is not authentic (NO at step S1010), the process proceeds directly to step S1030.

(5) At step S1025 in FIG. 10 of the above embodiment, in the counting machine 300, it is judged whether (the level difference between the visible light signal and the recognition set value)/recognition set value is less than a predetermined value. However, the configuration is not limited thereto. It can be configured such that the level difference between the visible light signal and the recognition set value is less than the predetermined value. Further, the predetermined value is set to 15%. However, the predetermined value is not limited thereto, and can be another value.

(6) At step S1035 in FIG. 10 of the above embodiment, it is judged whether the recognition margin value/recognition set value in the deposit machine 100 is less than a predetermined value. However, the configuration is not limited thereto. It can be configured to judge whether the recognition margin value is less than the predetermined value.

(7) For example, in FIG. 6 of the above embodiment, the recognition set value TH1 to be used in the deposit machine 100 and the recognition set value TH1 to be used in the counting machine 300 are set to the same value. However, the recognition set value is not limited thereto, and can be set to a different value. For example, if the visible light sensor 114 used in the deposit machine 100 and the visible light sensor 314 used in the counting machine 300 have the same characteristics, the recognition set value TH1 can be set to the same value in both the deposit machine 100 and the counting machine 300. If the visible light sensor 114 used in the deposit machine 100 and the visible light sensor 314 used in the counting machine 300 have different characteristics, the recognition set value TH1 can be set to a different value corresponding to the respective characteristics.

(8) In the above embodiment, in FIG. 6 or at step S1040 (FIG. 10), the counting machine 300 relaxes the recognition set value TH1 to the recognition set value TH2, which is to 80% of the recognition set value TH1. However, the relaxed recognition set value TH2 is not limited to 80% of the recognition set value TH1. The relaxed recognition set value TH2 can take any value, for example, in a range from 80% to 90% of the recognition set value TH1.

(9) In the above embodiment, the previous process data transmitted from the deposit machine 100 to the server device 200 includes the recognition margin value MG1. However, the previous process data is not limited thereto. The previous process data can include the recognition margin value/recognition set value, which is a quotient obtained by dividing the recognition margin value MG1 by the recognition set value TH1, instead of the recognition margin value MG1.

(10) In the above embodiment, the sorting machine 400 can also operate according to the flowchart illustrated in FIG. 9 and FIG. 10. Accordingly, the sorting machine 400 can also acquire the same effects as the counting machine 300.

(11) In the above embodiment, only the sorting machine 400 includes the fitness judgment unit 465. However, the configuration is not limited thereto. The deposit machine 100 can also include the fitness judgment unit. Instead of or in addition to the deposit machine 100, the counting machine 300 can include the fitness judgment unit.

(12) The banknote identification system 10 according to the above embodiment includes the sorting machine 400. However, the configuration is not limited thereto, and the sorting machine 400 may not be provided therein.

(13) The banknote identification system 10 according to the above embodiment identifies the authenticity of banknotes. However, the identification target is not limited to banknotes. The banknote identification system 10 can identify the authenticity of paper sheets, for example, marketable securities having a watermark region.

(14) In the above embodiment, the counting machine 300 acquires previous process data 500 generated by the deposit machine 100 via the network 10 and the server device 200. However, the configuration is not limited thereto, and the counting machine 300 can acquire the previous process data 500 not via the network 20 and the server device 200. For example, the counting machine 300 can acquire the previous process data 500 generated by the deposit machine 100 via a portable memory. The same holds true for the sorting machine 400.

The communication IF circuit 150 of the deposit machine 100 can transmit the previous process data 500 to a portable memory attached to the deposit machine 100 by wired communication, under control of the communication control unit 164. Alternatively, the communication IF circuit 150 of the deposit machine 100 can transmit the previous process data 500 to a portable memory arranged close to the deposit machine 100 by near-field communication, under control of the communication control unit 164. The communication IF circuit 150 and the communication control unit 164 correspond to an example of the first communication unit.

The communication IF circuit 350 of the counting machine 300 can receive the previous process data 500 from a portable memory attached to the counting machine 300 by wired communication, under control of the communication control unit 364. Alternatively, the communication IF circuit 350 of the counting machine 300 can receive the previous process data 500 from a portable memory arranged close to the counting machine 300 by near-field communication, under control of the communication control unit 364. The communication IF circuit 350 and the communication control unit 364 correspond to an example of the first acquisition unit.

In the present embodiment, it is permissible that the banknote identification system 10 does not include the network 20 and the server device 200. The portable memory includes, for example, a universal serial bus (USB) memory, a card-type memory such as an SD card memory, an IC tag, and a notebook personal computer (PC).

REFERENCE SIGNS LIST

10 banknote identification system
100 deposit machine
111, 311, 411 ultraviolet (UV) sensor
112, 312, 412 magnetic sensor
113, 313, 413 camera
114, 314, 414 visible light sensor
140 storage cassette
150, 350, 450 communication interface (IF) circuit
161, 361, 461 read control unit
162, 362, 462 authenticity recognition unit
164, 364, 464 communication control unit
192 serial number
200 server device
210, 220 communication IF circuit
241 communication control unit
230 memory
300 counting machine
340, 440 storage unit
400 sorting machine
TH1, TH2 recognition set value

The invention claimed is:

1. A paper sheet identification system comprising a first paper sheet identification device and a second paper sheet identification device, wherein the first paper sheet identification device includes a first read unit that reads a specific code described on a surface of a paper sheet to uniquely specify the paper sheet, at least one of first UV sensor, first magnetic sensor and first visible light sensor, a first identification unit that identifies authenticity of the paper sheet based on a first detection signal selected from an ultraviolet light signal output from the first UV sensor, a magnetic signal output from the first magnetic sensor, a visible light signal output from the first visible light sensor or combination thereof using a first set value as a reference, and a first storage unit that stores authentic paper sheets, which are paper sheets identified as authentic by the first identification unit, the first identification unit generates previous process data in which the specific code, the first set value, and a first identification result obtained by the first identification unit of the authentic paper sheet are associated with each other, the second paper sheet identification device includes a second read unit that reads the specific code described on the surface of the paper sheet, which has been taken out from the first storage unit and loaded into a slot, at least one of second UV sensor, second magnetic sensor and second visible light sensor, a second identification unit that identifies authenticity of the paper sheet based on a second detection signal selected from an ultraviolet light signal output from the second UV sensor, a magnetic signal output from the second magnetic sensor, a visible light signal output from the second visible light sensor or combination thereof using a second set value as a reference, a second storage unit that stores the paper sheets identified as authentic by the second identification unit, and a first acquisition unit that acquires the previous process data;

wherein in the case when the paper sheet is identified as authentic using the second set value, the paper is sheet stored in the second storage unit, whereas in the case when the paper sheet is identified as a counterfeit paper sheet, which is not authentic, using the second set value as a reference, the second identification unit performs a first process that extracts the first set value and the first identification result from the previous process data in which the first set value and the first identification result are associated with the specific code of the counterfeit paper sheet, and performs a second process that determines whether to relax the second set value based on the extracted first set value and the first identification result, wherein the second identification unit determines to relax the second set value, when a level difference between the first set value and the first detection signal acquired from the paper sheet or a quotient obtained by dividing the level difference by the first set value is less than a first threshold, and a second level difference between the second set value and the second detection signal acquired from the paper sheet or a quotient obtained by dividing the second level difference by the second set value is less than a second threshold, upon relaxation of the second set value, identifies authenticity of the counterfeit paper sheet using the relaxed second set value as a reference.

2. The paper sheet identification system according to claim 1, wherein the first set value and the second set value are same values.

3. The paper sheet identification system according to claim 1, wherein the first set value and the second set value are different values.

4. The paper sheet identification system according to claim 1, further comprising a third paper sheet identification device, wherein the third paper sheet identification device includes a third read unit that reads the specific code described on the surface of the paper sheet, which has been taken out from the second storage unit and loaded into a slot, a third identification unit that identifies authenticity of the paper sheet using a third set value as a reference, a third storage unit that stores the paper sheets identified as authentic by the third identification unit, and a second acquisition unit that acquires the previous process data, and the third identification unit extracts the first set value and the first identification result from the previous process data when the paper sheet is identified as a counterfeit paper sheet, which is not authentic, using the third set value as a reference, in which the first set value and the first identification result are associated with the specific code of a counterfeit paper sheet, determines whether to relax the third set value based on the extracted first set value and the first identification result, and upon relaxation of the third set value, identifies authenticity of the counterfeit paper sheet using the relaxed third set value as a reference.

5. The paper sheet identification system according to claim 1, further comprising an identified data management device configured to be communicable with the first paper sheet identification device and the second paper sheet identification device, wherein the first paper sheet identification device further includes a first communication unit that transmits the previous process data to the identified data management device, the identified data management device includes a management communication unit that receives the previous process data transmitted from the first communication unit of the first paper sheet identification device, and a management memory that memorizes the previous process data received by the management communication unit, the management communication unit transmits the previous process data memorized in the management memory to the second paper sheet identification device, and the first acquisition unit receives the previous process data transmitted by the management communication unit.

6. The paper sheet identification system according to claim 1, wherein the first paper sheet identification device further includes a first communication unit that stores the previous process data in a portable memory configured communicably, and the first acquisition unit acquires the previous process data from the portable memory in which the previous process data is stored.

* * * * *